United States Patent [19]

Hengesbach

[11] Patent Number: 4,629,121

[45] Date of Patent: Dec. 16, 1986

[54] FLOW CONTROL NOZZLE AND SHUTOFF VALVE HAVING SCREEN-CARRYING PASSAGE IN ROTATABLE STEM

[76] Inventor: Robert W. Hengesbach, 7886 Mentor Rd., Mentor, Ohio 44060

[21] Appl. No.: 715,353

[22] Filed: Mar. 11, 1985

Related U.S. Application Data

[63] Continuation-in-part of Ser. No. 398,145, Jul. 19, 1982, abandoned, which is a continuation-in-part of Ser. No. 461,872, Jan. 28, 1983, and a continuation-in-part of Ser. No. 461,873, Jan. 28, 1983.

[51] Int. Cl.[4] ..... B05B 15/02

[52] U.S. Cl. ..... 239/119; 239/393; 239/396; 239/575; 239/590.3; 239/600

[58] Field of Search ..... 239/119, 393, 396, 538, 239/569, 575, 590.3, 601, 600

[56] References Cited

U.S. PATENT DOCUMENTS

| | | | |
|---|---|---|---|
| D. 183,042 | 6/1958 | Fuglie . | |
| D. 254,146 | 2/1980 | Koenig . | |
| D. 254,322 | 2/1980 | Koenig . | |
| 336,602 | 2/1886 | Tomlinson | 239/448 |
| 370,836 | 10/1887 | Wilkins | 239/448 |
| 511,728 | 12/1893 | Deming | 239/396 |
| 564,500 | 7/1896 | Benedict et al. | 239/396 |
| 676,526 | 6/1901 | Anderson | 239/396 |
| 915,694 | 3/1909 | Pendergrass | 239/396 |
| 949,489 | 2/1910 | Mastin | 239/119 |
| 2,072,555 | 3/1937 | Hengesbach et al. . | |
| 2,157,269 | 5/1939 | Richter . | |
| 2,293,390 | 8/1942 | Hengesbach . | |
| 2,366,969 | 1/1945 | Kiggins . | |
| 2,564,938 | 8/1951 | Warren . | |
| 2,890,067 | 6/1959 | Morin . | |
| 2,929,406 | 3/1960 | Anderson | 239/569 |
| 3,116,882 | 1/1964 | Vork | 239/587 |
| 3,202,360 | 8/1965 | O'Brien | 239/393 |

List Continued on next page.

FOREIGN PATENT DOCUMENTS

| | | | |
|---|---|---|---|
| 874866 | 7/1971 | Canada . | |
| 937262 | 11/1973 | Canada . | |
| 952559 | 8/1974 | Canada . | |
| 998716 | 10/1976 | Canada . | |
| 1029422 | 4/1978 | Canada . | |
| 1040236 | 10/1978 | Canada . | |
| 1045657 | 1/1979 | Canada . | |
| 2266070 | 10/1975 | France | 239/396 |

OTHER PUBLICATIONS

Descriptive brochure "We Make the System", Tri-Con, Inc., 1977, 4 pages (otherwise not titled).

Bulletin 179F, Spraying Systems Co., 1971, 8 pages, Titled: "Spray Nozzles, Spray Guns, Valves and Accessories".

Industrial Catalog 27, Spraying Systems Co., 1978, 90 pages, titled: "Spray Nozzles and Accessories".

*Primary Examiner*—Jeffrey V. Nase
*Assistant Examiner*—Michael J. Forman
*Attorney, Agent, or Firm*—David A. Burge

[57] ABSTRACT

A flow control nozzle and shutoff valve has a housing which defines inlet and outlet openings on opposite sides thereof, and a flow channel extending therethrough for communicating the inlet and outlet openings. A control member is journaled by the housing for rotation about an axis that intersects the flow channel. The control member has a ball-shaped portion that is positioned along the flow channel. An elongate flow passage is formed through the ball-shaped portion of the control member. A curved, screen-like, flow regulating formation is positioned at one of the ends of the flow passage. The control member is movable relative to the housing among first, second and third control positions to selectively bring its flow passage into or out of alignment with the flow channel, and to selectively position the screen-like formation near the inlet and the outlet openings. When the control member is in its first control position, the screen-like formation is held in proximity to the inlet, and the flow of fluid that issues from the outlet takes the form of a solid, non-dispersed stream. When the control member is in its second control position, the screen-like formation is held in proximity to the outlet, and the flow of fluid that issues from the outlet is dispersed by the screen-like formation to form a spray. When the control member is in its third control position, the control member operates to close off fluid flow through the unit.

10 Claims, 18 Drawing Figures

U.S. PATENT DOCUMENTS 3,313,893 5/1967 Rodgers et al. ..... 239/393
3,475,039 10/1969 Ortloff .
3,632,046 1/1972 Hengesbach .
3,711,028 1/1973 Hengesbach .
3,756,273 9/1973 Hengesbach .
3,955,763 5/1976 Pyle et al. ..... 239/119
4,035,004 7/1977 Hengesbach .
4,206,877 6/1980 Hoza, III .
4,449,696 5/1984 Hengesbach .

FLOW CONTROL NOZZLE AND SHUTOFF VALVE HAVING SCREEN-CARRYING PASSAGE IN ROTATABLE STEM

REFERENCE TO RELATED APPLICATIONS AND RELEVANT PATENTS

The present application is a continuation-in-part of application Ser. No. 398,145, filed July 19, 1982 by Robert W. Hengesbach entitled FLOW CONTROL NOZZLE, hereinafter referred to as the "Parent Case," the disclosure of which is incorporated herein by reference, which case stands abandoned in favor of the present application.

The present application is also designated as a continuation-in-part of design applications Serial Nos. 461,872 and 461,873, both filed Jan. 28, 1983, and entitled, respectively, FLOW CONTROL VALVE AND NOZZLE and FLOW CONTROL VALVE AND NOZZLE WITH TAPERED BODY, hereinafter referred to as the "Design Cases," the disclosures of which are incorporated herein by reference.

Reference is also made to the following patents, the disclosures of which are incorporated herein by reference, these patents being referred to hereinafter as the "Reversible Screen Patents," namely:

VALVE WITH HANDLE-MOUNTING RING, U.S. Pat. No. 4,449,696 issued May 22, 1984, to Robert W. Hengesbach;

VALVE, U.S. Pat. No. 3,756,273 issued Sept. 4, 1973, to Robert W. Hengesbach;

SPRAY DEVICE, U.S. Pat. No. 3,711,028 issued Jan. 16, 1973, to Robert W. Hengesbach;

SPRAY DEVICE, U.S. Pat. No. 3,632,046 issued Jan. 4, 1972, to Robert W. Hengesbach; and, FAUCET, U.S. Pat. No. 2,072,555 issued Mar. 2, 1937, to L. J. Hengesbach et al.

BACKGROUND OF THE INVENTION

1. Field of the Invention

The present invention relates to a flow control nozzle and shutoff valve for selectively providing flow discharge patterns that include a solid-stream flow and a dispersed spray, and for preventing fluid flow through the unit.

2. Prior Art

While nozzle and valve structures of a variety of configurations have been proposed, the need has long remained for a flow control nozzle and shutoff valve unit that characteristically features a simple and inexpensive construction which can alternately provide choices among (1) a solid stream flow of fluid discharging or issuing from the unit, (2) a dispersed, spray-type discharge pattern for fluid that issues from the unit, and (3) a shutdown or cessation of fluid flow through the unit.

The use of rotatable flow control members carried by a housing of a nozzle and valve unit is known. By way of example, U.S. Pat. No. 3,319,893 issued May 16, 1967, to J. L. Rodgers et al, entitled SPRINKLER, discloses a device that utilizes a first rotatable flow control member that is carried within a housing for performing a valving function (i.e., to regulate the quantity of fluid flowing through the unit). The Rodgers device also utilizes a second rotatable flow control member that is carried by the housing at a location downstream from the first rotatable flow control member for performing a discharge control function (i.e., to provide a means of selecting from among a plurality of available discharge flow patterns for fluid issuing from the unit).

Prior proposals such as are exemplified by Rodgers et al result in units that characteristically feature a number of drawbacks. Such units are undesirably complex and expensive for use with outdoor water supply hoses, often referred to as "garden hoses," and do not provide durable, shock resistant structures that can withstand the usual type of relatively rough handling and dropping that is common in working with garden hose nozzles. Nor are such units well adapted to provide long-lived, reliable shutoffs for fluid flow that will function properly in the various environments of use of garden hoses which include exposures to winter weather as well as to the heat and ultraviolet radiation of summer sunshine. Moreover, the typically tortuous, significantly obstructed flow paths that such units define for the travel of fluid therethrough often undesirably diminishes the pressure at which fluid discharges from the outlets of the units.

A proposal for the use of a single rotatable fluid flow control member in a nozzle and valve unit to perform both a valving function and a discharge control function is presented by U.S. Pat. No. 676,526 issued June 18, 1901, to A. Anderson, entitled HOSE OR PIPE NOZZLE. The Anderson proposal utilizes a ball-shaped valve member that is carried by a housing and is rotatable selectively among three positions wherein the valve member cooperates with other structure to provide (1) a solid stream flow of fluid discharging or issuing from the unit, (2) a dispersed, spray-type discharge pattern for fluid that issues from the unit, or (3) a shutdown or cessation of fluid flow through the unit. Significant drawbacks of the Anderson proposal include the facts that (1) its implementation requires the provision of an expensively formed, ball-shaped valve member having a large number of entirely separate, elongate passages extending therethrough (each of the several passages must have ends that open through opposite faces of the valve member), and (2) the unit does not permit any of the passages to be reverse-flushed to clean away accumulated debris While the solid stream flow that the device produces is achieved by utilizing a single, relatively large diameter flow passage that should not be susceptible to clogging, the spray-type discharge of the device is achieved by utilizing a plurality of relatively small diameter flow passages, each of which is lengthy and is quite susceptible to clogging.

The concept of providing a flow control element at a location near one end of a flow passage, with the flow passage being reversible for flushing is known, a typical implementation thereof being the proposal of U.S. Pat. No. 3,116,882 issued Jan. 7, 1964, to W. D. Vork, entitled TURRET-NOZZLE FOR PAINT SPRAY GUNS. The Vork proposal provides a paint spray nozzle that is rotatably mounted such that the flow therethrough can be reversed in direction to effect reverse-flow cleaning of the nozzle passage. However, a drawback of proposals of this type is that the nozzle passages that they employ are not functional, when reverse-oriented, to provide discharge flow patterns that are useful other than to flush away accumulated debris. Certainly such proposals do not address the objective of providing a simple and inexpensive rotatable flow control element having a single through-passage for fluid flow that is provided with a screen-like formation, which passage is capable of being reverse-flow-flushed, and with the flow control element being cooperable with a housing in which it is mounted to provide choices among a solid stream flow of fluid discharging from the unit, a dispersed, spray-type discharge pattern for fluid that issues from the unit, and a shutdown or cessation of fluid flow through the unit.

3. The Referenced Patents and Applications

The referenced Parent Case included a full and complete disclosure of all of the features that form the subject matter of the invention claimed herein. The present case has been filed as a continuation-in-part principally to comply with the requirement of the patent law for "best mode" disclosure by making reference to and incorporating herein the teachings of the referenced Design Cases that depict what are now considered to be preferred embodiments for carrying out the practice of the present invention. Because the claims of the present case do not extend to subject matter that is beyond the scope of the disclosure of the Parent Case, it will be understood that (1) the filing date of the referenced Parent Case is applicable to the subject matter that is claimed herein, and (2) the incorporation herein of the subjects matter of the referenced Design Cases (and the presentation herein of six views of drawings that are essentially copied from the referenced Design Cases) has been done principally to comply with the requirement of the patent law that calls for including in a newly filed application the best mode known to the inventor at the time of filing of the application for carrying out the practice of the claimed invention.

While the product configurations that form the subjects matter of the referenced Design Cases are not essential to the practice of the present invention, such configurations do represent the preferred modes of practicing the invention. Thus, while there is a relationship between the present invention and the inventions of the referenced co-pending Design Cases, there is likewise a line of demarcation between their subject matter and the subject matter of the present case. Moreover, the subjects matter of the present case and that of the referenced cases is the work product of the same inventor.

The referenced Reversible Screen Patents disclose fluid control valves having screen-carrying sleeves connected to their outlets. Each of the sleeves has a flow passage formed through it. Opposite end regions of the flow passages are threaded so that either of the ends of the sleeves may be threaded onto a valve housing outlet. Each of the sleeves carries a concave-convex screen at a location midway along the length of its flow passage. Depending upon which end of the sleeve is threaded onto the outlet of a valve housing, the screen will be oriented to cause either convergence or divergence of the flow of fluid passing through the sleeve. These patents have relevance to the extent that the basic types of concave-convex screens they disclose can be mounted in rotatable valving members and used in one form of practice of the present invention, as was described in the referenced Parent Case, and as is described herein.

SUMMARY OF THE INVENTION

The present invention overcomes the foregoing and other drawbacks of prior proposals by providing a novel and improved flow control nozzle and shutoff valve unit having a control member that is rotatably carried by a housing and that has a screen-like flow regulating formation for selectively providing either a dispersed, divergent spray pattern, or a solid stream flow of fluid issuing from the nozzle, and with the components of the unit being arranged such that the screen-like flow regulating formation and the flow passage with which it is associated can be reverse-flow-flushed to clean the unit of accumulated debris.

Features of nozzle and valve units that embody the preferred practice of the invention lie in the utilization such units make of a single, rotatable control member (1) that performs both valving and discharge control functions, and (2) that employs a single through passage for fluid flow that has a screen-like flow regulating formation at one end thereof and that can be reverse-flushed to clean away accumulated debris.

In accordance with the preferred practice of the present invention, a flow control nozzle and shutoff valve has a housing which defines inlet and outlet openings on opposite sides thereof, and a flow channel extending therethrough for communicating the inlet and outlet openings. A control member is journaled by the housing for rotation about an axis that intersects the flow channel. The control member has a ball-shaped portion that is positioned along the flow channel. An elongate flow passage is formed through the ball-shaped portion of the control member. A curved, screen-like, flow regulating formation is positioned at one of the ends of the flow passage. The control member is movable relative to the housing among first, second and third control positions to selectively bring its flow passage into or out of alignment with the flow channel, and to selectively position the screen-like formation near the inlet and the outlet openings. When the control member is in its first control position, the screen-like formation is held in proximity to the inlet, and the flow of fluid that issues from the outlet takes the form of a solid, non-dispersed stream. When the control member is in its second control position, the screen-like formation is held in proximity to the outlet, and the flow of fluid that issues from the outlet is dispersed by the screen-like formation to form a spray. When the control member is in its third control position, the control member operates to close off fluid flow through the unit.

A feature of nozzle and valve units that embody the preferred practice of the invention lies in the simplicity of their construction. A housing of generally cylindrical, elongate configuration defines a flow-through passage with an inlet for attachment to a source of pressurized fluid, such as a garden hose, and an outlet through which pressurized fluid is to be discharged. A rotary stem having a ball-shaped valving portion is journaled by the housing. A flow-through passage is formed in the ball-shaped valving portion and is alignable with the passage formed through the housing to selectively position a concave-convex screen such that it either does not disturb the provision of a straight-through flow of fluid, or serves to disperse the discharging flow to form a divergent spray pattern. Additionally, the rotary stem may be oriented with respect to the housing such that it serves to shutoff flow through the housing.

In preferred practice, a pair of seals are carried by the housing for cooperating with opposed parts of the spherical outer surface of the ball-shaped portion of the rotatable stem. One of the seals preferably takes the form of a conventional "hose washer" of the type that is commonly used to establish leak free connection between a garden hose and a conventional hose nozzle, or between two interconnected garden hoses The other preferably takes the form of a conventional O-ring. The housing is configured such that, when a male end of a conventional garden hose is threaded into a threaded inlet portion of the housing, the hose washer is engaged by the male end of the hose and is compressed into engagement both with a shoulder that is provided inside the housing and with the rotatable stem whereby a seal is formed directly between the rotatable stem and the hose end; by this arrangement, when the stem is oriented so as to present to the hose end a surface portion that shuts off fluid flow, a direct seal is made by the hose washer between the hose end and the surface portion. A further feature lies in the provision of the O-ring seal which also cooperates with the ball-shaped portion of the rotatable stem to shutoff fluid flow through the unit. When the hose washer is in place and functions properly, the O-ring seal provides a "back up" or secondary seal that is available to help assure that proper shutoff takes place. However, if the hose washer becomes worn or malfunctions, the O-ring seal will serve as a primary seal to provide the needed leak free closure.

BRIEF DESCRIPTION OF THE DRAWINGS

The foregoing and other features of the present invention will be better understood by referring to the description of the preferred embodiments and the claims which follow, taken in conjunction with the accompanying drawings, wherein:

DESCRIPTION OF THE PREFERRED EMBODIMENTS

Figure 1:
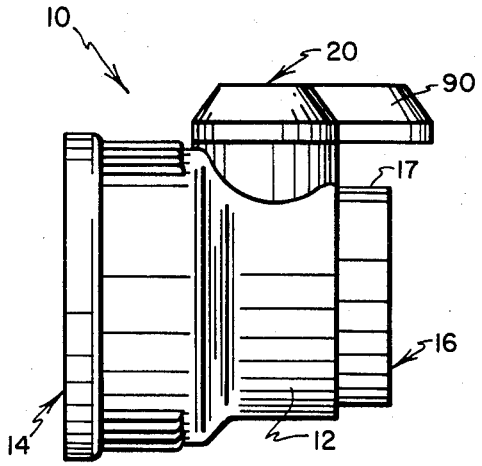
FIG. 1 is a side elevational view of one embodiment of a nozzle and valve unit incorporating features of the present invention, with a rotatable control member of the nozzle in a first control position.
Figure 2:
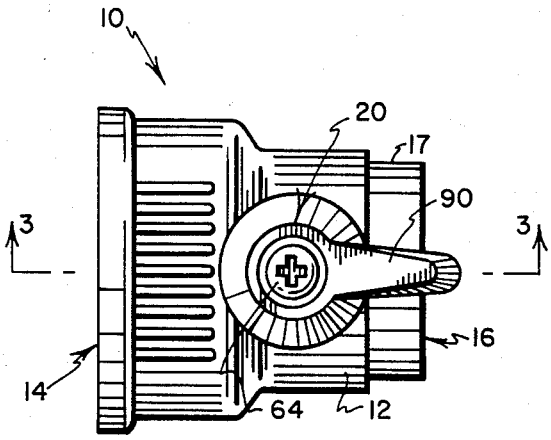
FIG. 2 is a top plan view thereof.

Referring to FIGS. 1–5, one embodiment of a flow control nozzle and shutoff valve unit incorporating features of the present invention is indicated generally by the numeral 10. The nozzle and valve unit 10 includes a housing 12 which defines an inlet 14 and an outlet 16 at opposite ends thereof.

Figure 3:
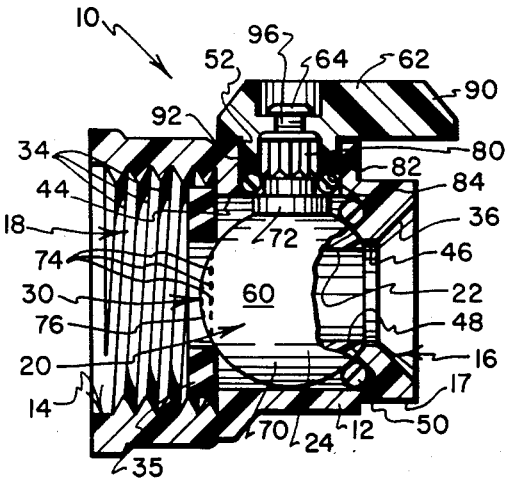
FIG. 3 is a sectional view as seen substantially from a plane indicated by a line 3—3 in FIG. 2.
Figure 4:
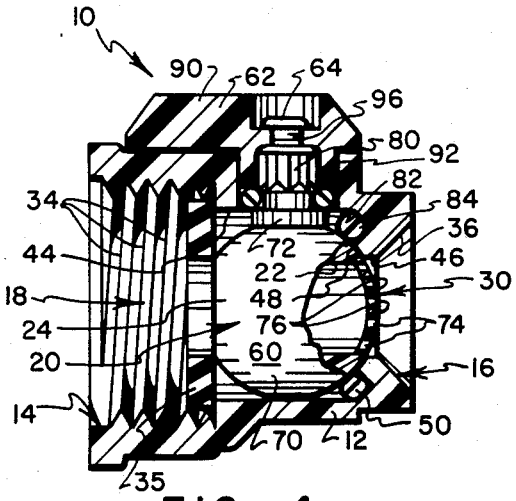
FIGS. 4 and 5 are sectional views similar to FIG. 3 but with the rotatable control member of the nozzle and valve unit in second and third control positions, respectively.
Figure 5:
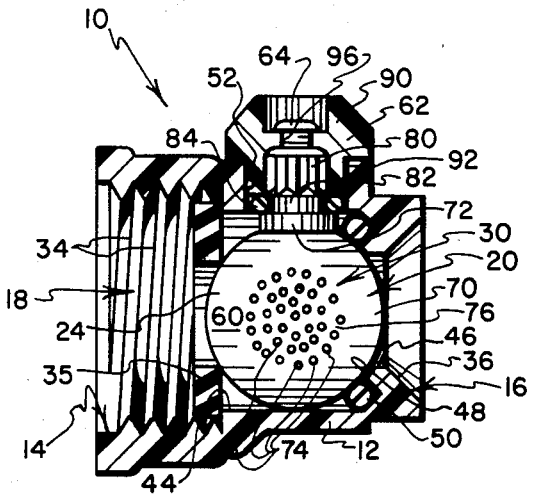

Referring to FIGS. 3–5, the inlet 14 takes the form of an internally threaded connector. The outlet 16 takes the form of a divergent exit. A flow channel 18 is formed through the housing 12 to communicate the inlet 14 and outlet 16. A rotatable control member 20 is journaled by the housing 12. The control member 20 has an elongate, cylindrical flow passage 22 formed therethrough. A flow regulating formation in the form of a concave-convex screen 30 is carried by the control member 20 near one end of the flow passage 22. When the control member 20 is rotated to a first control position (1) to align the flow passage 22 with the flow channel 18 and (2) to position with the screen 30 in proximity to the inlet 14, as is shown in FIG. 3, pressurized fluid flowing from the inlet 14 and discharging through the outlet 16 will have its discharge pattern governed by the configuration of the elongate flow passage 22, and will discharge through the outlet 16 as a non-dispersed, solid-stream flow. When the control member 20 is rotated to a second control position (1) to align the flow passage 22 with the flow channel 18 and (2) to position the screen 30 in proximity to the outlet 16, as shown in FIG. 4, pressurized fluid flowing from the inlet 14 and discharging through the outlet 16 will have its discharge pattern governed by the configuration of the screen 30 (as may be assisted in some instances by the configuration of the divergent outlet passage 16), and will discharge in a controlled, dispersed spray pattern. When the control member 20 is rotated to a third control position to orient the flow passage 22 transverse to the flow channel 18, as shown in FIG. 5, solid wall portions 24 of the control member assembly 20 are positioned to extend across the flow channel 18, whereby fluid flow through the nozzle 10 is shut off.

Turning now to a more detailed description of the components of the nozzle and valve unit 10, the housing 12 is depicted as being formed from rigid plastics material using injection molding techniques. The inlet 14 is provided with female threads 34 configured to receive the threaded male end connector of a conventional garden hose. An annular seal 35, preferably taking the form of a conventional "hose washer," is provided to establish a leak free connection with a conventional garden hose (such a connection being depicted in FIG. 9 wherein a threaded end of a conventional garden hose is indicated by the numeral 133 is shown in the inlet 114 of a similar form of nozzle 110, as will be described).

The outlet 16 of the unit 10 is shown as having a divergent wall which takes the form of a truncated conical surface 36 that is inclined relative to the axis of the flow channel 18 at an angle of about 45 degrees. The flow channel 18 has a relatively large diameter portion 44 which communicates with the inlet 14, a relatively smaller diameter portion 46 which communicates with the outlet 16, and a transition zone 48 which carries a sealing ring 50 (preferably a conventional O-ring). A hole 52 is formed through the housing 12 and opens into the large diameter portion 44.

Figure 6:
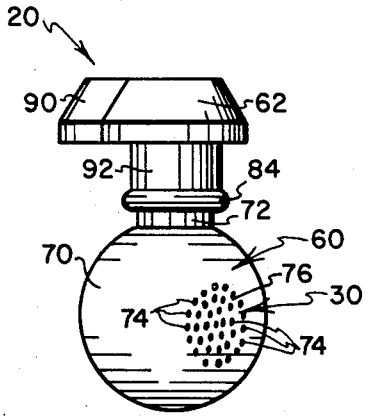
FIG. 6 is a side elevational view of the rotatable control member employed in the nozzle and valve unit of FIGS. 1–5.
Figure 7:
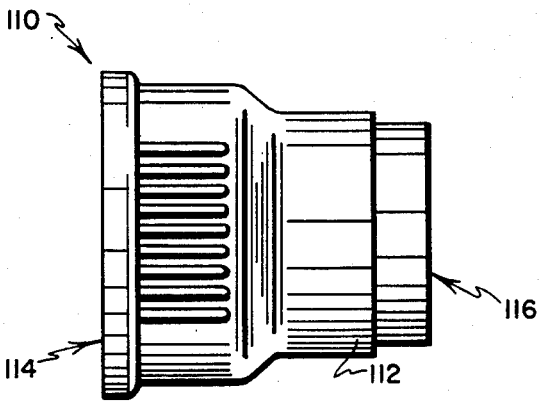
FIG. 7 is a bottom plan view of the nozzle and valve unit of FIGS. 1–5 with the control member in its second control position.

Referring to FIG. 6 in conjunction with FIGS. 1–5, the control member assembly 20 includes a body 60, a handle 62, and a threaded fastener 64 which holds the body 60 and the handle 62 together. The body 60 and the handle 62 are formed separately from rigid plastics material using injection molding techniques. The fastener 64 is a Phillips head screw, preferably formed from a corrosion-resistant metal such as brass.

The body 60 has a substantially spherical (i.e., ball-shaped) control portion 70 and an upstanding stem 72. The flow passage 22 extends through the spherical control portion 70. The screen 30 is preferably formed by a plurality of small holes 74 which extend through a thin wall 76 located at one end of the flow passage 22.

In preferred practice the screen 30 is provided with about three dozen holes 74 having diameters within the range of about 0.020 to 0.025 inch, and the thickness of the wall 76 is approximately 0.020 inch. By this arrangement, the holes 74 may be molded so that they all have axes that extend substantially parallel to the axis of the passage 22, and yet the screen 30 will, by virtue of its curved configuration, cause a discharging flow to disperse to form a spray when the components of the unit 10 are oriented as depicted in FIG. 4.

The stem 72 has a splined upper end region 80. A circumferentially-extending groove 82 is provided on the stem 72. An O-ring 84 is positioned in the groove 82 and engages the housing 12 in the vicinity of the hole 52 and prevents leakage through the hole 52 along the stem 72.

The handle 62 has an elongate operating lever 90 from which depends a cylindrical mounting boss 92. A splined passage 94 is provided in the boss 92 for receiving and establishing a driving connection with the splined end portion 80 of the control member 72. A hole 96 is provided through the handle 62 to receive the threaded fastener 64. The fastener 64 extends through the hole 96 and threads into an aligned hole (not shown) formed in the control member 72.

A feature of the nozzle 10 lies in the cooperation which is achieved among the flow passage 22, the screen 30 and the divergent outlet wall 36 to selectively provide either a solid stream discharge or a dispersed spray. When the control member 20 is in its first control position, shown in FIG. 3, the screen 30 is positioned upstream from the flow passage 22 (i.e., near the inlet 14), and does nothing more than to duct pressurized fluid from the inlet 14 into the flow passage 22. The elongate flow passage 22 guides the flow of pressurized fluid through the outlet 16, providing a solid-stream flow. When the control member 20 is in its second control position, shown in FIG. 4, the screen 30 is positioned downstream with respect to the flow passage 22 (i.e., near the outlet 16), and projects into the small diameter portion 46 of the flow channel 18 to a position in close proximity to the divergent outlet wall 36. The curved screen 30 functions to provide a dispersed spray discharge pattern for fluid discharging through the outlet 16. To the degree that the divergent outlet wall 36 is configured to engage the discharging spray-like flow, the outlet wall 36 can be utilized to conform the resulting spray pattern to exactly the desired configuration that may be needed by a particular customer or application.

Figure 9:
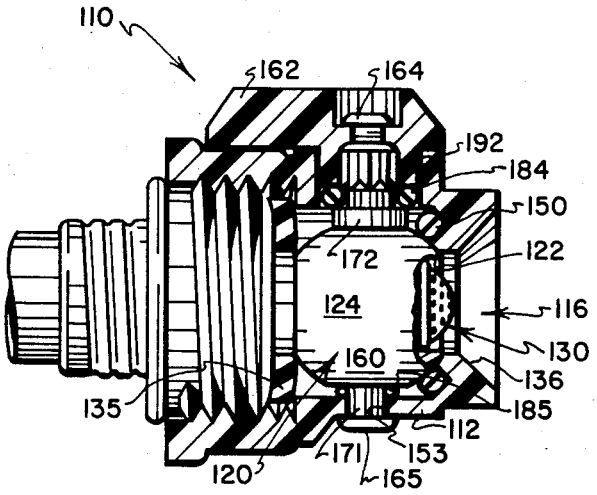
FIG. 9 is a sectional view similar to FIG. 4 of an alternate form of nozzle and valve unit employing the alternate control member of FIG. 8, with the alternate control member in its second control position, and with a threaded end of a conventional garden hose being shown received in the inlet of the nozzle and valve unit.
Figure 10:
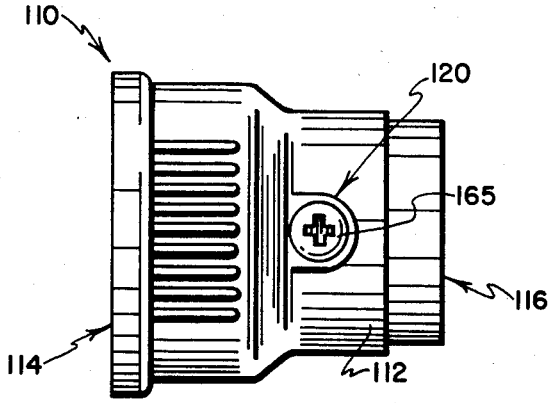
FIG. 10 is a bottom plan view of the nozzle and valve unit of FIG. 9, with the control member thereof in its second control position.

Referring to FIGS. 9 and 10, a second embodiment of a flow control nozzle and shutoff valve unit incorporating features of the present invention is indicated generally by the numeral 110. The unit 110 includes a housing 112 which defines an inlet 114 and an outlet 116 at opposite ends thereof. A flow channel 118 is formed through the housing 112 to communicate the inlet 114 and the outlet 116. A rotatable control member 120 is journaled by the housing 112.

The nozzle 110 is identical to the nozzle 10 except with respect to the configuration and mounting of the control member 120. Accordingly, only such portions of the nozzle 100 as differ from the nozzle 10 need be described in detail. Corresponding parts of the nozzles 10, 110 are indicated in the drawings by numerals which differ by a magnitude of one hundred.

Figure 8:
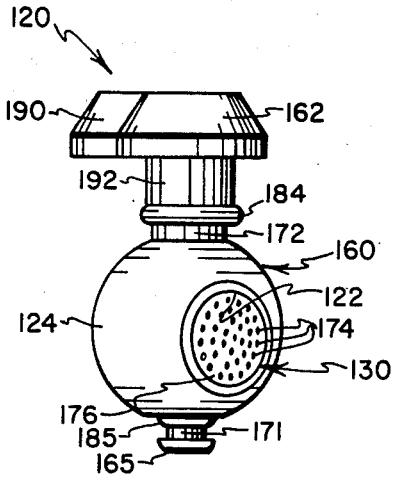
FIG. 8 is a side elevational view similar to FIG. 6 of an alternate form of rotatable control member.

Referring to FIG. 8 in conjunction with FIGS. 9 and 10, the control member 120 has a flow passage 122 formed therethrough. A concave-convex screen 130 is carried by the control member 120 near one end of the flow passage 122. The screen 130 is shown as comprising a separate metal member which is installed (typically pressed into place) in one end of the flow passage 122. The screen 130 as utilized in the embodiment of FIGS. 8–10 is of the type that is utilized in the referenced Reversible Screen Patents.

When the control member 120 is positioned (1) to align the flow passage 122 with the flow channel 118 and (2) to position with the screen 130 in proximity to the inlet 114 (as has been described in conjunction with the nozzle embodiment of FIGS. 1–5 and as has been illustrated in FIG. 3), pressurized fluid flowing from the inlet 114 and discharging through the outlet 116 will discharge in a solid stream flow. When the control member 120 is positioned (1) to align the flow passage 122 with the flow channel 118 and (2) to position the screen 130 in proximity to the outlet, as is shown in FIG. 9, pressurized fluid flowing from the inlet 114 and discharging through the outlet 116 will be dispersed by the screen 130 for discharge through the outlet along the divergent outlet wall 136 in a controlled spray pattern. When the control member 120 is rotated to a third control position to orient the flow passage 122 transverse to the flow channel 118 (as has been described in conjunction with the nozzle embodiment of FIGS. 1–5 and as has been illustrated in FIG. 5), solid wall portions 124 of the control member assembly 120 are positioned to extend across the flow channel 118, whereby fluid flow through the nozzle 110 is shut off.

The control member 120 has a lower stem portion 171 which depends through and is journaled by a hole 153 formed through the housing 110. A threaded fastener in the form of a Phillips head screw 165 extends through the hole 153 and is threaded into the stem portion 171. An O-ring 185 is carried on the stem portion 171 to prevent fluid leakage through the hole 153 along the stem portion 171.

An important feature of the nozzles 10, 110 is the significant reduction in cost with which these units can be produced, as compared with such assemblages of prior art components as are intended to perform similar functions. The aligned and closely spaced arrangement of the inlets 14, 114 and their corresponding outlets 16, 116 and flow channels 18, 118 and the progressively diminishing diameter of the channels 18, 118 that lets seals and control member elements be installed quickly and easily by inserting them through the inlets 14, 114 contribute to this feature. Stated in another way, due to the simplicity of construction of nozzles 10, 110 these units can be assembled with ease, thereby further diminishing fabrication costs.

Figure 11:
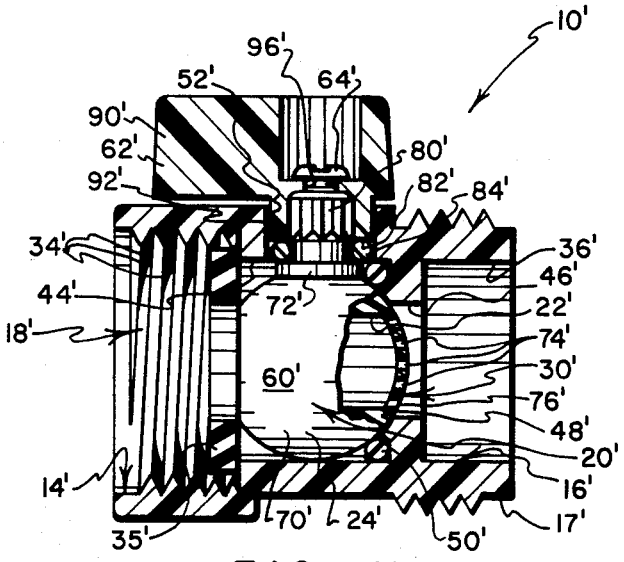
FIGS. 11 and 12 are sectional views similar to FIG. 4, showing still other alternate forms of nozzle and valve units that embody the preferred practice of the present invention.

While the nozzles 10, 110 are depicted as being formed primarily from plastics materials and configured for use with a garden hose, it will be understood that features of the present invention can be incorporated in nozzles formed from a wide variety of materials and configured for use in a wide diversity of applications. By way of one example, the components of the nozzles 10, 110 can be machined or otherwise formed from metal, as illustrated by the nozzle embodiments 10' shown in FIGS. 11, 13, 15, and the nozzle embodiment 10" shown in FIGS. 12, 14, 16. By way of another example, features of the invention can be incorporated in nozzles which carry other conventional forms of valving devices such as butterfly valves. By way of still another example, a nozzle 210 configured for use with a fire hose and having its major components formed from metal is illustrated by the ball valve embodiments of FIGS. 17 and 18. Other forms of nozzles having housing inlets configured for attachment to kitchen and bathroom faucets, and the like, can be provided, as will be readily apparent to those skilled in the art.

Figure 12:
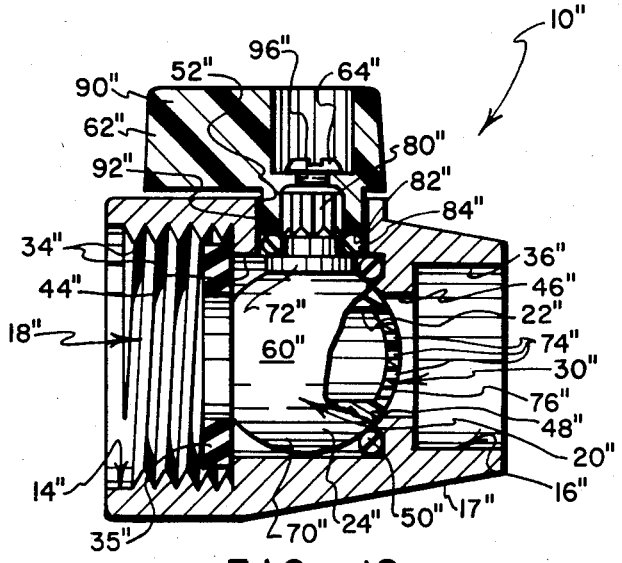
Figure 14:
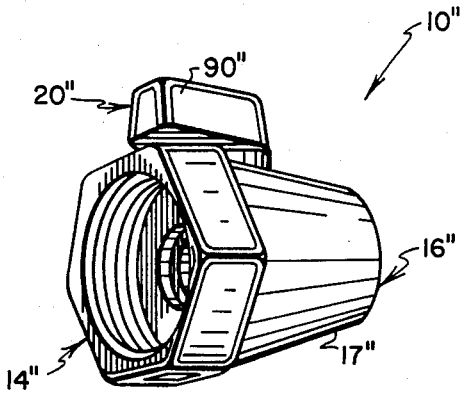
FIGS. 13 and 14 are perspective view of the alternate forms of nozzle and valve units of FIGS. 11 and 12, respectively.
Figure 13:
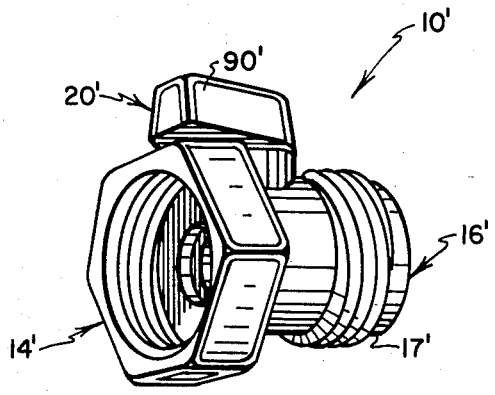
Figure 16:
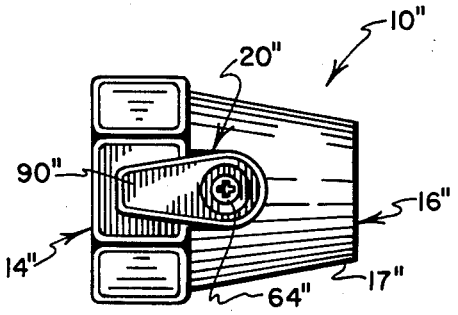
FIGS. 15 and 16 are top plan views of the alternate forms of nozzle and valve units of FIGS. 13 and 14, respectively.
Figure 15:
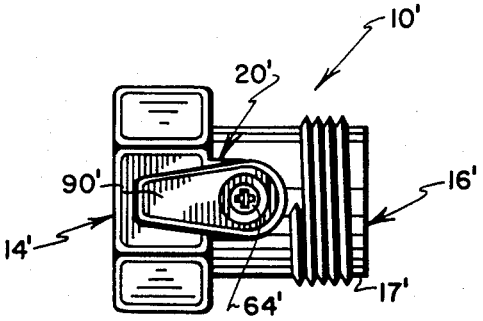

Referring to FIGS. 11–16, it will be understood that, in order to be thorough and in order to comply with "best mode" requirements of the patent law, these figures have essentially been copied from the referenced Design Cases. The nozzle embodiment 10' of FIGS. 11, 13 and 15, and the nozzle embodiment 10" of FIGS. 12, 14 and 16, are, with only minor changes in dimensions and proportions of their components, identical both in configuration and function to the above-described embodiment 10. Because components of the nozzles 10', 10" have functionally equivalent, substantially identical components in the described nozzle 10, corresponding components of the nozzles 10', 10" are designated by the same numbers as the components of the nozzle 10, but are accompanied, respectively, by single and double "prime" marks.

Both of the nozzles 10', 10" have non-tapered outlet walls 36', 36" that differ from the tapered outlet surface 36 of the nozzle 10—however, the provision of a tapered wall 36 has been found to be unnecessary for most applications, thus the nozzles 10, 10' and 10" remain functionally equivalent for most uses. While the nozzle 10 has a generally cylindrical, non-threaded outer surface 17 on the outlet end of its housing 12, the nozzles 10', 10" have threaded and tapered outer surfaces 17, 17", respectively, with the tapered surface 17' being provided for asthetic purposes, and with the threaded surface 17" permitting connection of the nozzle 10" to a female end connection of a garden hose. While the operating levers 90', 90" of the nozzles 10', 10" are larger in size than is the lever 90 of the nozzle 10, the size change is simply a matter of designer's choice.

Figure 17:
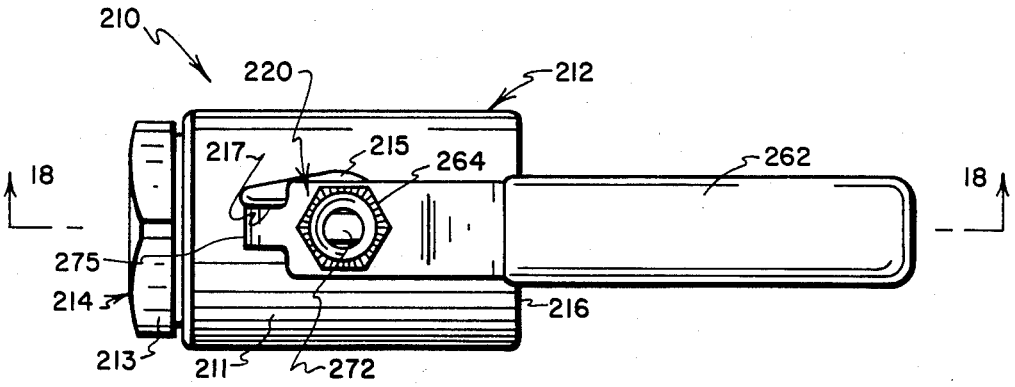
FIG. 17 is a top plan view of still another form of nozzle and valve units embodying features of the present invention; and, FIG. 18 is a sectional view as seen from a plane indicated by a line 18—18 in FIG. 17.
Figure 18:
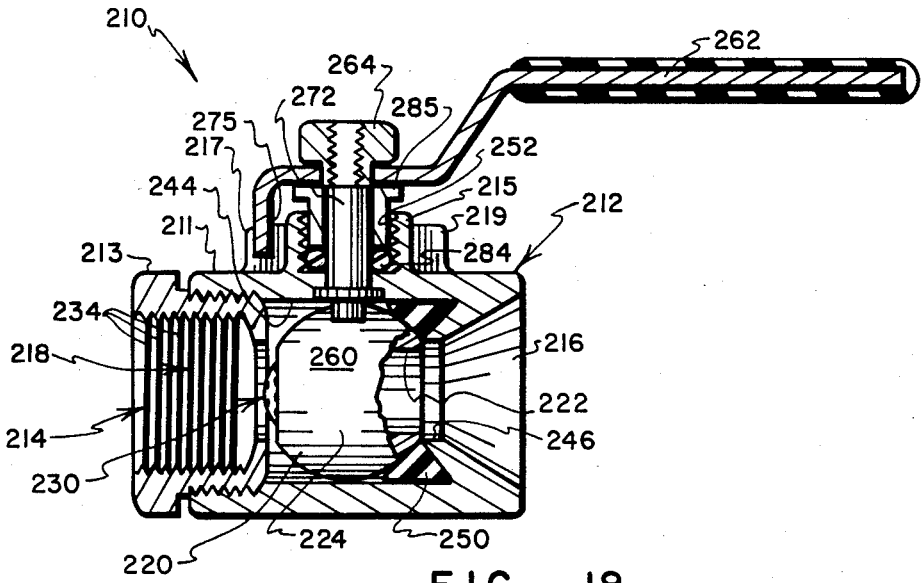

Referring to FIGS. 17 and 18, the nozzle 210 includes a housing 212 which defines a threaded inlet 214 and a divergent outlet 216 at opposite ends thereof. A flow channel 218 is formed through the housing 212 to communicate the inlet 214 and outlet 216.

A rotatable control member 220 is journaled by the housing 212. The control member 220 has a flow passage 222 formed therethrough. A concave-convex screen 230 is carried on the control member 220 near one end of the flow passage 222. When the control member 220 is rotated to a first control position (1) to align the flow passage 222 with the flow channel 218 and (2) to position the screen 230 in proximity to the inlet 214, as shown in FIG. 17, pressurized fluid flowing from the inlet 214 and discharging through the outlet 216 will discharge in a solid stream flow. When the control member 220 is rotated to a second control position (1) to align the flow passage 222 with the flow channel 218 and (2) to position the screen 230 in proximity to the outlet, pressurized fluid flowing from the inlet 214 and discharging through the outlet 216 will be dispersed by the screen 230 and will discharge in a controlled spray pattern as guided by the divergent outlet passage 236. When the control member 220 is rotated to orient the flow passage 222 transverse to the flow channel 218, solid wall portions 224 of the control member assembly 220 are positioned across the flow channel 218, and fluid flow through the nozzle 210 is prevented.

Turning now to a more detailed description of the components of the nozzle 210, the housing 212 comprises a two-piece metal structure including a generally tubular case 211 and an inlet bushing 213 which is threaded into the case 211. Female threads 234 are provided internally of the bushing 213 to receive a fire hose or other source of pressurized fluid. The case defines a relatively large diameter inlet portion 244 and a smaller diameter outlet portion 246. A packing 250 is carried at the junctures of the portions 244, 246 to sealingly engage the control member 220.

An upstanding boss 215 is provided on the case 211. A pair of stop formations 217, 219 extend from opposite sides of the boss 215. A hole 252 is formed through the boss 215 and opens into the flow channel portion 244. The upper end region of the hole 252 is threaded and carries a packing 284. A bushing 285 is threaded into the hole 252.

The control member 220 has a generally spherical body 260, a stem 272 which extends from the body 260 through the hole 252 and through the bushing 285, and a handle 262 which is secured to the stem 272 by a nut 264. The handle 262 has a stop projection 275 which engages one or the other of the stop formations 217, 219 when the control member is in its first or second control positions.

When the handle 262 is rotated ninety degrees with respect to the position shown in FIGS. 17 and 18, solid wall portions 224 of the control member 220 are positioned to extend across and close the flow channel 218, whereby no fluid is permitted to issue through the outlet 216.

As will be apparent from the foregoing description, features of nozzle and valve units that embody the preferred practice of the invention lie in the utilization such units make of a single, rotatable control member (1) that performs both valving and discharge control functions, and (2) that employs a single through passage for fluid flow that has a screen-like flow regulating formation at one end thereof and that can be reverse-flushed to clean away accumulated debris.

Still other features that result from the use of units that embody the preferred practice of the present invention result from the use within such units of a pair of seals that are carried by the housings of each such unit for cooperating with opposed faces of the spherical outer surfaces of the ball-shaped portions of the rotatable stems of the units. In each such unit, one of the seals preferably takes the form of a conventional "hose washer" of the type that is commonly used to establish leak free connection between a garden hose and a conventional hose nozzle, or between two interconnected garden hoses. The other preferably takes the form of a conventional O-ring. The housing is configured such that, when a male end of a conventional garden hose is threaded into a threaded inlet portion of the housing, the hose washer is engaged by the male end of the hose and is compressed into engagement both with a shoulder that is provided inside the housing and with the spherical outer surface of the ball-shaped portion of the rotatable stem, whereby a seal is formed directly between the rotatable stem and the hose end; by this arrangement, when the stem is oriented so as to present to the hose end a surface portion that shuts off fluid flow, a direct seal is made by the hose washer between the hose end and the surface portion. A further feature lies in the provision of the O-ring seal which also cooperates with the ball-shaped portion of the rotatable stem to shutoff fluid flow through the unit. When the hose washer is in place and functions properly, the O-ring seal provides a "back up" or secondary seal that is available to help assure that proper shutoff takes place. However, if the hose washer becomes worn or malfunctions, the O-ring seal will serve as a primary seal to provide the needed leak free closure.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A combined flow control, nozzle and shutoff valve unit, comprising:

(a) an elongate housing having spaced portions thereof that include structure which defines an inlet, an outlet, and a flow channel that extends through the housing to provide a generally linear flow path that communicates the inlet and the outlet, with the inlet being adapted for connection to a source of pressurized fluid;

(b) the housing further defining mounting formation means including a first hole formed through a portion of the housing for communicating with the flow channel at a location between the inlet and the outlet;

(c) flow control means including a flow control member having projecting formation means that is journaled in the first hole to provide for rotary movement of the flow control member relative to the housing about an imaginary axis of rotation that extends through the first hole and that intersects with the flow channel, with rotary movement of the flow control member relative to the housing about said axis being permitted among at least first, second and third control positions;

(d) the flow control member additionally having structure defining a generally spherical outer surface for extending across the flow channel at a location between the inlet and the outlet, with the generally spherical outer surface having a diameter as measured along the flow path that causes opposite side portions of the spherical outer surface to extend into close proximity with the inlet and the outlet;

(e) the flow control member further having an elongate flow passage extending substantially centrally therethrough and having opposed first and second end regions that open through opposite sides of the spherical outer surface, with the flow passage being oriented such that:

(i) when the flow control member is in the first control position, the flow passage is aligned with the flow channel to communicate the inlet and the outlet, the first end region is positioned near to and communicates with the inlet, and the second end region is positioned near to and communicates with the outlet;

(ii) when the flow control member is in the second control position, the flow passage is aligned with the flow channel to communicate the inlet and the outlet, the first end region is positioned near to and communicates with the outlet, and the second end region is positioned near to and communicates with the inlet; and, (iii) when the flow control member is in the third control position, the flow passage is oriented to extend transversely with respect to the flow channel and does not communicate the inlet and the outlet;

(f) the flow passage being of substantially uniform diameter along its length except in the vicinity of the first end region wherein dispersion spray discharge means is provided including structure that defines a thin, outwardly convex wall that joins with the spherical outer surface in a substantially contiguous manner and that extends transversely across the flow passage to close the flow passage except for the provision of a multiplicity of relatively small diameter openings that are formed through the thin wall in an array that defines a screen-like structure, and with the second end region defining solid stream discharge means consisting of a single opening means that is substantially the same diameter as said uniform diameter of the flow passage;

(g) inlet seal means including a generally annular inlet seal:

(i) for establishing a seal between the housing inlet and the spherical outer surface of the flow control means;

(ii) for engaging the spherical outer surface to establish substantially leak-free communication between the inlet and the flow passage of the flow control means when the flow control means is in the first and second control positions; and, (iii) for cooperating with the spherical outer surface of the flow control member to shut off fluid flow from the inlet to the flow channel when the flow control member is in the third control position;

(h) outlet seal means including a generally annular outlet seal:

(i) for establishing a seal between the housing outlet and the spherical outer surface of the flow control means;

(ii) for engaging the spherical outer surface to establish substantially leak-free communication between the outlet and the flow passage of the flow control means when the flow control member is in the first and second control positions; and, (iii) for cooperating with the spherical outer surface of the flow control member to shut off fluid flow from the flow channel through the outlet when the flow control member is in the third control position;

(i) the flow control member being operable when in its first control position to position the dispersion spay discharge means at a sufficient distance upstream from the outlet so that the dispersion spray discharge means provides substantially no deterrent to the establishment of a flow of pressurized fluid through the flow passage for discharge through the outlet as a solid-stream flow;

(j) the flow control member being operable when in its second control position to direct pressurized fluid that has been admitted to the flow passage through the inlet for discharge through the outlet as a dispersed spray of fluid; and, (k) the inlet seal means and the outlet seal means engaging and cooperating with opposed side portions of the spherical outer surface when the flow control member is in the third control position to shut off fluid flow from the inlet to the outlet; and (l) the housing defines an annular shoulder that is adjacent where the flow channel joins the inlet, the inlet includes structure defining an internally threaded region that extends adjacent the shoulder, the inlet seal is positioned within the internally threaded region adjacent the shoulder, and the internally threaded region, the shoulder and the inlet seal are configured to cooperate such that, when an externally threaded end region of a fluid supply conduit is threaded into the internally threaded region, said conduit is caused to compress radially outer portions of the annular inlet seal into engagement with the shoulder, and to compress radially inward portions of the inlet seal into sealing engagement with the spherical outer surface of the flow control member.

2. The combined flow control, nozzle and shutoff valve of claim 1 wherein the their convex wall that defines the screen-like structive has a thickness that is about 0.020 inch.

3. The combined flow control, nozzle and shutoff valve unit of claim 1 wherein the holes that are formed through the thin convex wall that defines the screen-like structure are within the range of about 0.020 to about 0.025 inch in diameter.

4. The combined flow control, nozzle and shutoff valve unit of claim 1 wherein the thin convex wall that defines the screen-like structure has a substantially uniform thickness that is about the same as the diameter of the holes that are formed through said wall.

5. The combined flow control, nozzle and shutoff valve unit of claim 1 wherein the thin convex wall that defines the screen-like structure is formed integrally with such portions of the control member as define the flow passage.

6. The combined flow control, nozzle and shutoff valve unit of claim 5 wherein the screen-like structure and such portions of the control members as define the flow passage are formed as a one-piece molded structure of rigid plastics material.

7. The combined flow control, nozzle and shutoff valve unit of claim 1 additionally including a divergent outlet passage means formed on the housing, through which discharging fluid passes, the divergent outlet passage means being configured to provide no obstruction to the solid-stream flow of fluid which issues from the outlet when the control member is in its first control position, and being configured to cooperate with the dispersion spray discharge means of the flow control member to assist in providing a controlled spray pattern of discharging fluid when the flow control member is in its second position.

8. The combined flow control, nozzle and shutoff valve unit of claim 1 wherein the flow control member includes an operator-engageable formation located externally of the housing for facilitating movement of the flow control member relative to the housing.

9. The combined flow control, nozzle and shutoff valve unit of claim 8 wherein the operator-engageable formation includes an elongate lever.

10. The combined flow control, nozzle and shutoff valve unit of claim 1, wherein:

(a) the mounting formation means includes a second hole formed through the housing in alignment with the first hole; and, (b) the mounting formation means includes structure that is journaled in the second hole and that is connected to the flow control member to assist in mounting the flow control member on the housing for rotary movement about the axis of rotation.

* * * * *